United States Patent [19]

Young et al.

[11] Patent Number: 4,949,569

[45] Date of Patent: Aug. 21, 1990

[54] CONTAINER REPAIR APPARATUS

[76] Inventors: Almon A. Young, 156 Riverside Dr., Pittsburg, Calif. 94565; William T. Martin, 21483 Waalew Rd., Apple Valley, Calif. 92307

[21] Appl. No.: 354,705

[22] Filed: May 22, 1989

[51] Int. Cl.[5] ..... B21D 39/20

[52] U.S. Cl. ..... 72/392; 72/446; 72/457; 72/705

[58] Field of Search ..... 72/457, 705, 393, 469, 72/379, 399, 392

[56] References Cited

U.S. PATENT DOCUMENTS

| | | | |
|---|---|---|---|
| Re. 30,914 | 4/1982 | Chisum | 72/457 |
| 2,334,080 | 11/1943 | Freeman | 72/293 |
| 2,442,939 | 6/1948 | Schram | 72/399 |
| 3,201,968 | 8/1965 | Hill | 72/705 |
| 3,408,848 | 11/1968 | Lague et al. | 72/705 |
| 3,525,249 | 8/1970 | Bellemare | 72/705 |
| 3,776,019 | 12/1973 | Shaw | 72/705 |
| 4,400,968 | 8/1983 | Barbieri | 72/705 |
| 4,555,926 | 12/1985 | Bieli-Moschlin et al. | 72/705 |

*Primary Examiner*—David Jones
*Attorney, Agent, or Firm*—Allan M. Shapiro

[57] ABSTRACT

Apparatus has a forming die on a boom with the boom being positionable so that the forming die can be urged outward against the damaged wall of a container. Hammering on the outside of the container against the forming die reshapes the container wall to its original contours.

8 Claims, 2 Drawing Sheets

FIG. 1
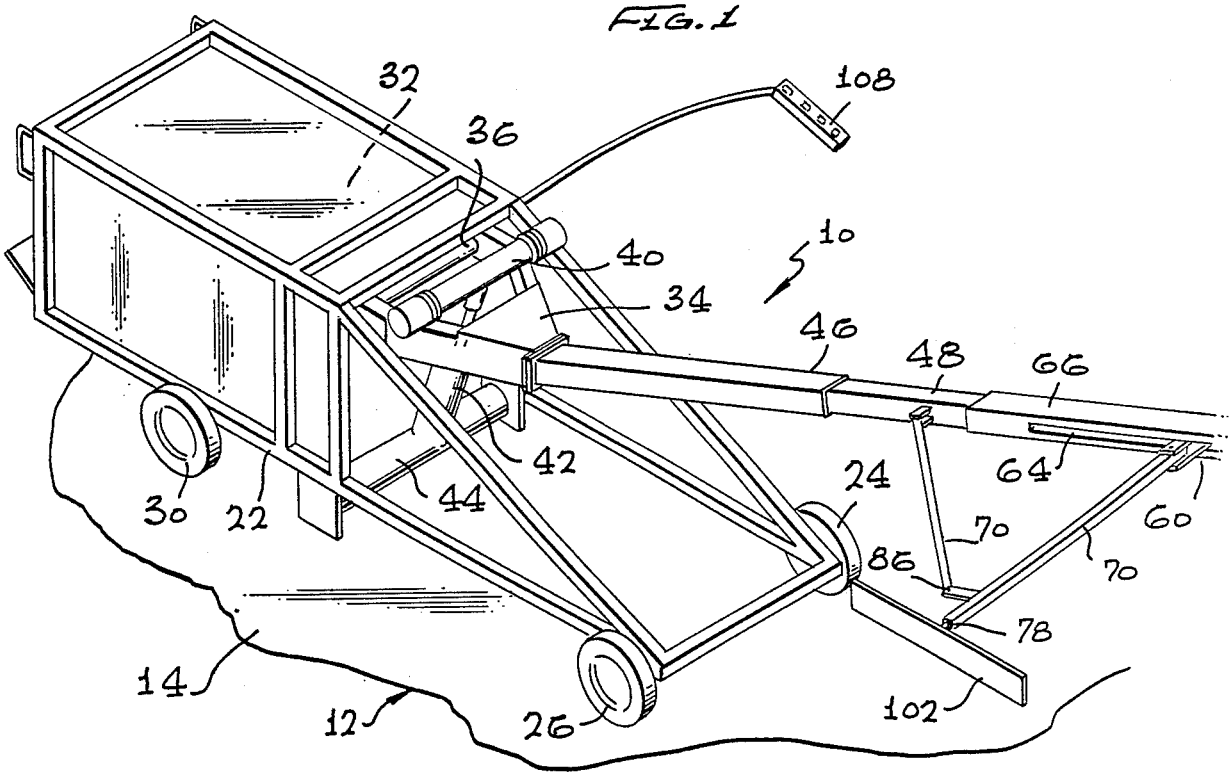
FIG. 5A
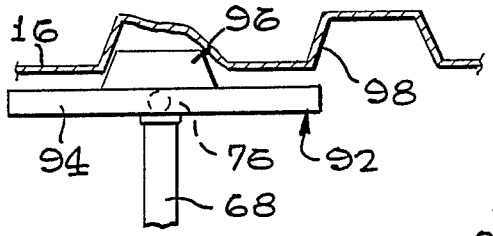
FIG. 5B
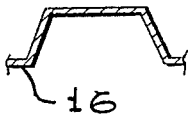
FIG. 2
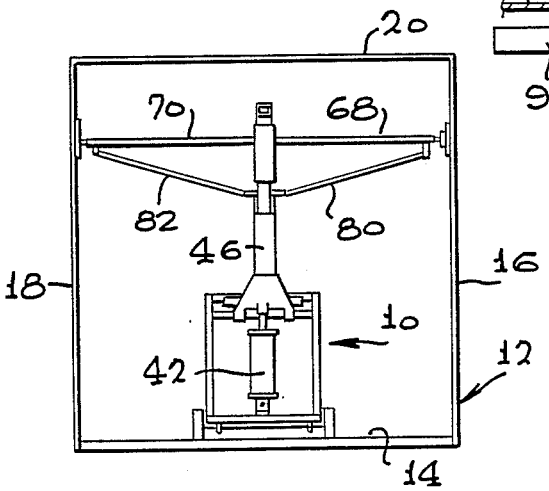
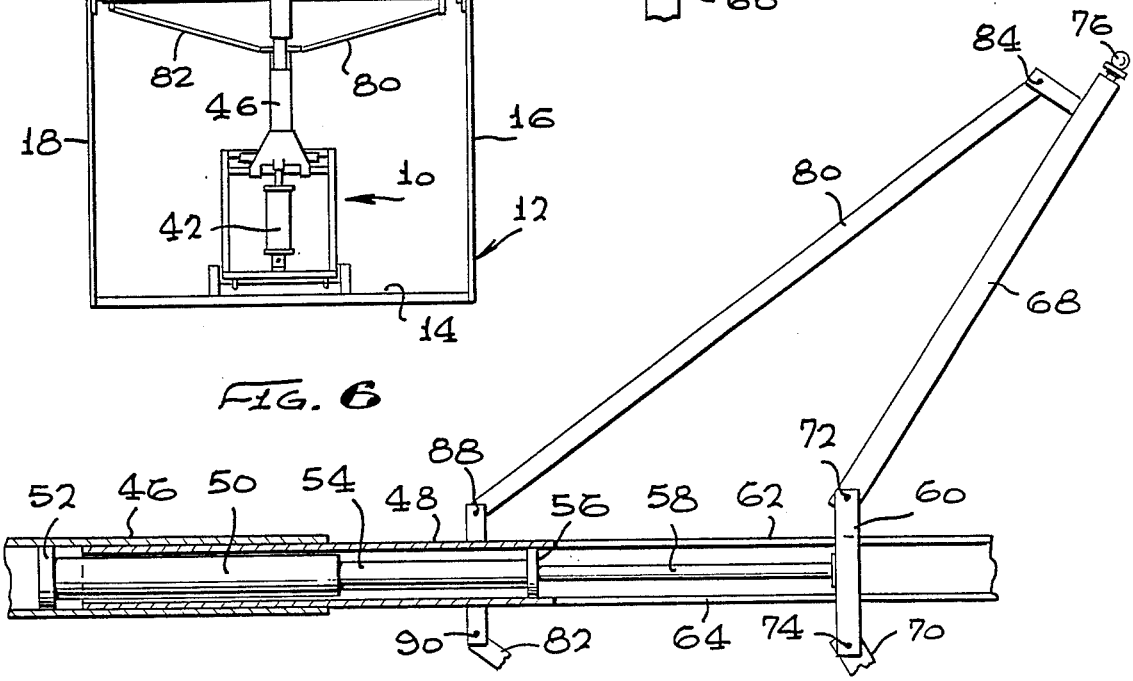
FIG. 6

12
14
16
18
22
24
26
28
30
32
34
35
36
38
40
42
44
46
48
50
60
64
66
68
70
72
74
80
82
84
86
88
90
92
94
96
100
102
104
106
108
5A
6
10

CONTAINER REPAIR APPARATUS

FIELD OF THE INVENTION

This invention is directed to a container repair apparatus which forces a forming die outwardly against the damaged wall of a container so that the damaged wall can be hammered back into proper configuration.

BACKGROUND OF THE INVENTION

Shipping containers are widely used in the transport of materials. Such containers are long, rectangular structures having corrugated walls to enhance container strength. Such containers are used to receive articles of merchandise and constrain and protect the articles of merchandise while they are stored and/or shipped. Shipping may be by means of rail, truck and/or ship. In the course of such activities, the containers are often the subject of damage. The damage most often evidences itself as dents and creases in one or the other side wall of the container. In repairing such a container to restore it to full strength, that portion of the side wall which is damaged may be cut out and replaced. Welding is necessary for reasonable strength of the replacement, but welding anneals the adjacent side walls and reduces the normal strength thereof. Furthermore, cutting out and replacing a portion of the side wall is an expensive and time-consuming process.

Accordingly, apparatus to aid in proper container repair by reshaping the damaged metal walls back to their original configuration is desirable.

SUMMARY OF THE INVENTION

In order to aid in the understanding of this invention, it can be stated in essentially summary form that it is directed to a container repair apparatus which includes a boom which is mounted to be adjustable in position and which can carry a forming die thereon so that the forming die can be pressed against a damaged portion of the container wall so that hammering opposite the forming die can reshape the damaged wall back to its original configuration.

It is thus an object and advantage of this invention to provide a container repair apparatus which is capable of placing a forming die against a damaged container wall and which is easy and economic to use so that repairing the container wall is quick and convenient.

It is another object and advantage of this invention to provide a container repair apparatus which enters within a container and presses a forming die against a portion of one wall to be repaired while it presses a shoe on the opposite wall to aid in holding the forming die in place.

It is another object and advantage of this invention to provide a container repair apparatus which can be quickly and easily employed in a shipping container, a truck body, and in similar large structures so as to support a damaged wall thereof for the repair of the damaged wall.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a perspective view of the container repair apparatus of this invention, with parts broken away.

FIG. 2 is a front elevational view thereof, on a reduced scale.

FIG. 5A is an enlarged vertical section through a damaged container wall showing the forming die pressed against the inside thereof.

FIG. 5B is a similar section through the same wall showing the wall after repair.

FIG. 6 is an enlarged section through the boom as seen generally along the line 6—6 of FIG. 3, with parts broken away.

DESCRIPTION OF THE PREFERRED EMBODIMENT

Figures 3, 4, 7:
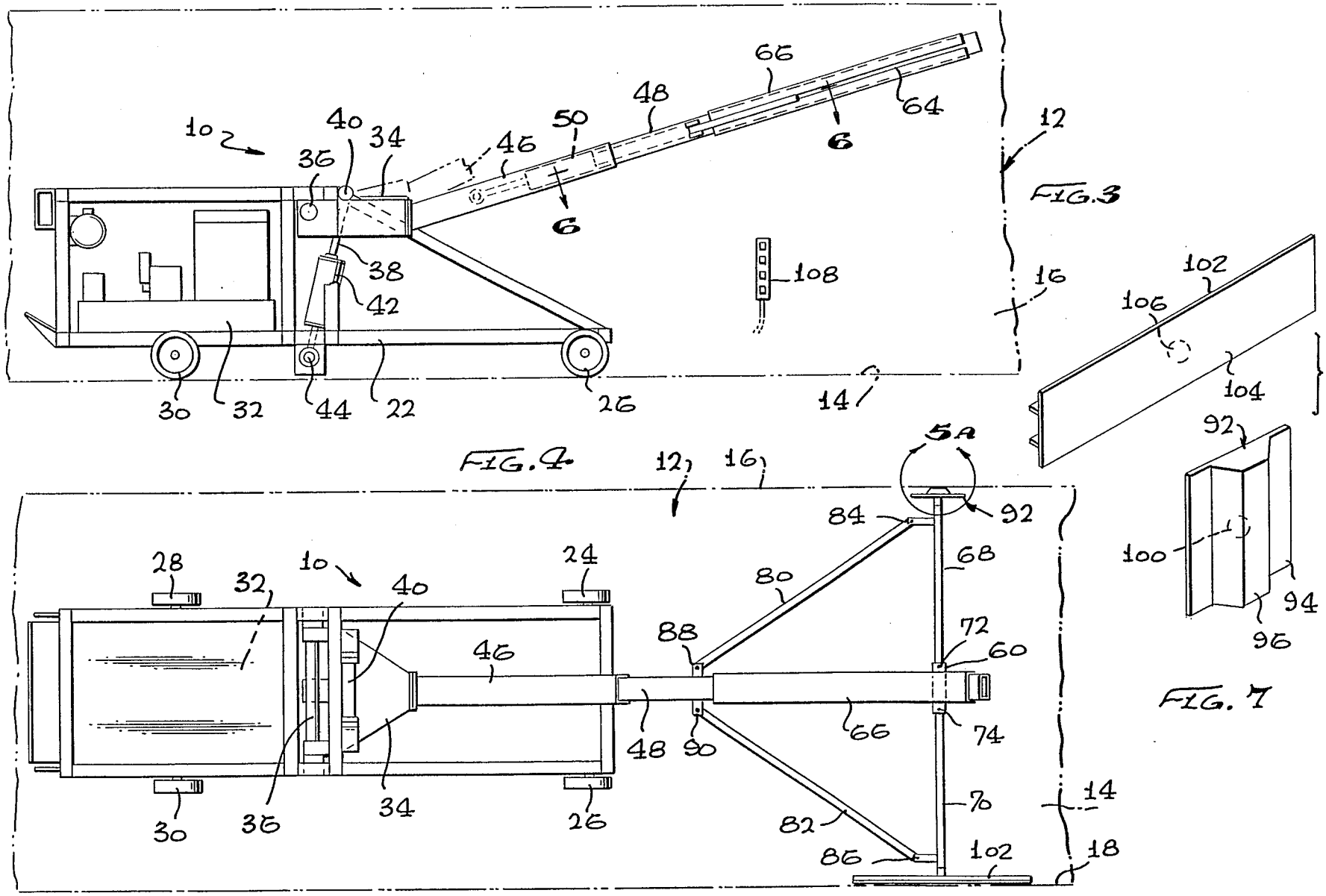
FIG. 3 is a side-elevational view thereof, on a larger scale than FIG. 2.
FIG. 4 is a plan view thereof.
FIG. 7 is an enlarged perspective view of an example of a suitable forming die and of the shoe used oppositely thereto.

The container repair apparatus of this invention is generally indicated at 10 in FIGS. 1, 2, 3 and 4. The apparatus is for use in repairing the side walls of large rectangular containers. Container 12 has a floor 14, left and right side walls 16 and 18, as the side walls are seen in entering from the open end of the container, top 20. Left side wall 16 is shown in detail in FIGS. 5A and 5B. It is the left side wall 16 that is illustrated as being damaged and being repaired by the apparatus 10.

The apparatus 10 comprises a frame 22 supported on front left and right wheels 24 and 26 and on rear left and right wheels 28 and 30. The frame and wheels are sized so that the apparatus can be rolled into the container 10 on the container floor 14. Frame 22 carries power unit 32, see FIG. 3, which supplies hydraulic fluid under pressure for the operation of the movable parts o the apparatus 10. The power unit 32 may also supply other forms of power, such as compressed air and lighting for the interior of the container, should such be desired. Frame 22 has V-shaped boom carrier 34 pivoted thereon on pivot shaft 36. Boom lift ram 38 is connected to cross bar 40 on the top of the boom carrier. Boom lift cylinder 42 is pivoted on cross bar 44, which is secured to the bottom of the frame. Hydraulic fluid under pressure is controlled by valves to cause extension or retraction of the boom lift ram 38 out and into its cylinder. This causes raising and lowering of boom carrier 34.

Boom 46 is fixed to the boom carrier and is raised and lowered therewith. Boom 46 is a tubular square boom which extends generally to the front end of frame 22. Boom telescope 48 is also a square tube, telescopically received within boom 46 and slidably mounted therein. A hydraulic cylinder controls the extension of boom telescope 48. Cylinder 50 is fixed on its inner end by bracket 52 to boom 46. Cylinder 50 carries therein piston rod 54, which is fixed at its outer end by means of bracket 56 to the interior of boom telescope 48, see FIG. 6. By controlling hydraulic fluid to the cylinder 50, boom telescope 48 extends and retracts with respect to boom 46.

Piston rod 54 is hollow and serves as a cylinder in which slides a piston carried on piston rod 58. Slide 60 moves in slots 62 and 64 in the sides of boom telescope 48. Piston rod 58 is fixed to the slide so that the slide moves in and out with respect to the boom telescope in accordance with the hydraulic control of piston rod 58 in its cylinder within piston rod 54. Boom telescope 48 can be strengthened at slots 62 and 64 by attaching thereto an embracing square tube which is secured thereto, as by welding, and is provided with corresponding slots so that slide 60 extends outward. Reinforcement is thus achieved at the area of the slots, see FIGS. 1, 3 and 4. Left and right arms 68 and 70 are respectively carried on pivots 72 and 74 on slide 60.

The outer ends of the arms respectively carry balls 76 and 78 on which forming tools can be carried. The manner in which the arms swing around their pivots is respectively controlled by connectors 80 and 82. The connectors 80 and 82 are respectively pivoted on arms 68 and 70 at pivots 84 and 86. The near ends of the connectors are respectively pivoted on pivots 88 and 90, which are carried on brackets secured to boom telescope 48. The lengths of the connectors, the lengths of the right and left arms, and the stroke of slide 60 along the length of boom telescope 48 is such that, in the extended position shown in FIGS. 2 and 4, the left and right arms are substantially at right angles with respect to the length and direction of the stroke of piston rod 58. A partially retracted position of slide 60 is shown in FIG. 6 where the arms are partially withdrawn.

Forming die 92, best seen in FIGS. 5A and 7, has a backing plate 94 which carries die projection 96. The die projection is configured to exactly fit into a correct corrugation recess, such as the one shown at 98 in FIG. 5A. The die projection represents the desired configuration of the corrugation. The backing plate has therein a ball socket 100, shown in dotted lines in FIG. 7, so that the forming die can be carried on the end of one of the arms. The opposite arm carries shoe 102. Shoe 102 has a flat face 104 which is sufficiently large that it can engage over a large area of the opposite, presumably undamaged wall of the container. Shoe 102 has a ball socket 106 herein, see FIG. 7, so that it may be mounted on the arm opposite the forming die.

In repairing a damaged container wall, where the damage is adjacent the open end, the apparatus 10 can remain outside of the container and reach into the container. Where the damage is farther in, the apparatus is placed in the container. The operator controls piston rod 54 to place the forming die at the correct location forward of the frame of the apparatus and controls the boom lift cylinder 42 to obtain the correct height of the forming die. He extends piston rod 58 to move slide 60 forward in order to spread the distance between the balls 76 and 78 and thus spread the distance between shoe 102 and forming die 92. He places the forming die into the corrugation to be repaired. An associate worker hammers on the exterior surface of the side wall, directly adjacent the forming die, to shape the side wall to the configuration of the forming die. For this reason, the forming die must be the exact shape of the undamaged corrugation. Exterior hammering can be accomplished by employment of an air-driven hammer or similar device which delivers rapid blows. The forming die is forced out as the wall shape is rehammered into the correct position.

Communication between the operator positioning the forming die and the hammer operator is essential. The operator who controls the apparatus and positions the forming die is directed by the hammer operator. A large force can be applied by the forming die onto the container wall because the reaction force is taken up over a large area of the opposite wall by shoe 102. The forming die can be quickly and easily moved up and down a corrugation and into adjacent corrugations by control of the three principal hydraulic cylinders for raising the boom, telescoping the boom, and spreading the die and shoe away from each other. The operator is preferably close to the point where the die is engaging on the container wall. In order to conveniently control the apparatus, he is provided with a pendant 108 which is connected to control all of the described functions of the apparatus. In this way, the forming die is pressed outward against the container wall at the point of hammering so that reshaping of the container wall back to its desired configuration is easily accomplished. It is understood that, for different corrugation shapes, different shapes of the forming die 92 are provided.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An apparatus for repairing one of the first and second spaced metal walls of a container, comprising:

a frame sized so that it may enter between the first and second spaced metal walls;

a boom on said frame so that said boom may enter between the first and second walls;

metal forming die holding means on said boom for holding a forming die for engagement against the first wall of the container so that the first wall can be hammered opposite the forming die to shape the first wall in accordance with the configuration of the forming die;

backing plate holding means on said boom for holding a backing plate for engagement with the second wall opposite the engagement of the forming die with the first wall; and means on said boom for spreading said forming die holding means away from said backing plate holding means so that the forming die can be urged against the first wall while the backing plate is urged against the second wall to hold the forming die in place, said means for spreading comprising left and right arms, each arm having one end pivotally mounted on said boom and the other end of each arm being mounted to one of said backing plate holding means or forming die holding means, said arms being pivoted with respect to said boom to separate said holding means.

2. The repair apparatus of claim 1 wherein said left and right arms are each pivoted to a slide and a motor is connected to move said slide along said boom to separate said holding means from each other.

3. The repair apparatus of claim 2 wherein said boom is telescoping so as to permit positioning of said holding means at a selected distance away from said frame.

4. The repair apparatus of claim 3 wherein left and right connectors are respectively pivoted to said left and right arms and are also pivoted to said boom so that movement of said slide moves said arms with respect to said connectors.

5. The repair apparatus of claim 4 wherein said motor is a hydraulic cylinder mounted in said boom and there is also a hydraulic cylinder mounted in said boom for controlling the amount of telescopic extension of said boom.

6. The repair apparatus of claim 5 wherein said boom is pivotally mounted on said frame so that said boom can be raised and lowered with respect to said frame to raise and lower said holding means on said boom so that said holding means can be positioned at a selected height with respect to the first and second walls and there is a hydraulic cylinder for raising and lowering said boom with respect to said frame.

7. An apparatus for repairing one of the first and second spaced metal walls of a container, comprising:

a frame sized so that it may enter between the first and second spaced metal walls;

a boom on said frame so that said boom may enter between the first and second walls;

metal forming die holding means on said boom for holding a forming die for engagement against the first wall of the container so that the first wall can be hammered opposite the forming die to shape the first wall in accordance with the configuration of the forming die;

backing plate holding means of said boom for holding a backing plate for engagement with the second wall opposite the engagement of the forming die with the first wall;

means on said boom for spreading said forming die holding means away from said backing plate holding means so that the forming die can be urged against the first wall while the backing plate is urged against the second wall to hold the forming die in place;

said boom being pivotally mounted on said frame so that said boom can be raised and lowered with respect to said frame to raise and lower said holding means on said boom so that said holding means can be positioned at a selected height with respect to the first and second walls; and a slide movably mounted along the length of said boom, a motor connected to said boom and to said slide to move said slide to a selected position, first and second arms respectively pivoted to said slide, said holding means respectively being carried by said first and second arms, first and second connectors respectively pivoted to said first and second arms to said boom so that the position of said slide along said boom controls the distance between said holding means so that a forming die and a backing plate respectively held by said holding means can be forced against the first and second sides of a container.

8. The repair apparatus of claim 7 wherein said repair apparatus is sized so that it may enter within a standard truck-mountable shipping container for engaging against the walls thereof for the repair of the walls thereof.

* * * * *